US010559413B2

(12) United States Patent
Yoon et al.

(10) Patent No.: US 10,559,413 B2
(45) Date of Patent: Feb. 11, 2020

(54) COIL ELECTRONIC COMPONENT

(71) Applicant: SAMSUNG ELECTRO-MECHANICS CO., LTD., Suwon-si, Gyeonggi-do (KR)

(72) Inventors: Chan Yoon, Suwon-si (KR); Dong Hwan Lee, Suwon-si (KR); Young Ghyu Ahn, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/809,606

(22) Filed: Nov. 10, 2017

(65) Prior Publication Data

US 2018/0240586 A1 Aug. 23, 2018

(30) Foreign Application Priority Data

Feb. 20, 2017 (KR) ..... 10-2017-0022547

(51) Int. Cl.
*H01F 17/00* (2006.01)
*H01F 27/06* (2006.01)
(Continued)

(52) U.S. Cl.
CPC ..... *H01F 27/06* (2013.01); *H01F 27/24* (2013.01); *H01F 27/327* (2013.01); *H01F 2027/065* (2013.01)

(58) Field of Classification Search
CPC ..... H01F 17/0013
See application file for complete search history.

(56) References Cited

U.S. PATENT DOCUMENTS 6,996,892 B1 * 2/2006 Dening ..... H01F 17/0013 29/602.1
2007/0205856 A1 * 9/2007 Matsunaga ..... H01F 17/0013 336/200
(Continued)

FOREIGN PATENT DOCUMENTS

JP 05-050708 U 7/1993
JP H11-054336 A 2/1999
(Continued)

OTHER PUBLICATIONS

Office Action issued in corresponding Japanese Patent Application No. 2017-220141, dated Jul. 17, 2018.
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil electronic component includes a first coil and a second coil disposed on and beneath a main board, respectively, wherein the first coil includes a first coil pattern and a second coil pattern connected to each other through a first via of a first insulating layer and disposed on and beneath the first insulating layer, respectively, and the second coil includes a third coil pattern and a fourth coil pattern connected to each other through a second via of a second insulating layer and disposed on and beneath the second insulating layer, respectively. In this case, the main board, the first insulating layer, and the second insulating layer include through-holes formed in central portions thereof, respectively.

19 Claims, 2 Drawing Sheets

I-I'

(51) Int. Cl.
*H01F 27/24* (2006.01)
*H01F 27/32* (2006.01)

(56) References Cited

U.S. PATENT DOCUMENTS

2008/0290977 A1 11/2008 Ito et al.
2013/0169399 A1* 7/2013 Yoo ..... H01F 17/0013 336/180
2013/0169404 A1* 7/2013 Jeong ..... H01F 27/2804 336/200
2013/0222101 A1* 8/2013 Ito ..... H01F 17/04 336/83
2013/0234819 A1* 9/2013 Yoo ..... H01F 17/0013 336/200
2013/0249664 A1* 9/2013 Tonoyama ..... H01F 41/04 336/200
2014/0022041 A1* 1/2014 Park ..... H01F 17/0013 336/199
2014/0145812 A1* 5/2014 Lee ..... H01F 17/0013 336/200
2014/0285305 A1* 9/2014 Yoo ..... H01F 27/2804 336/200
2015/0035640 A1* 2/2015 Wang ..... H01F 17/0006 336/200
2015/0102889 A1 4/2015 Choi et al.
2015/0340149 A1* 11/2015 Lee ..... H05K 1/181 174/260
2016/0078986 A1 3/2016 Yoon et al.
2016/0217917 A1 7/2016 Jeong
2017/0032884 A1 2/2017 Choi et al.

FOREIGN PATENT DOCUMENTS

JP 2007-67214 A 3/2007
JP 2008072071 A * 3/2008
JP 2008-166625 A 7/2008
JP 2013-201375 A 10/2013
JP 2014229739 A * 12/2014
JP 2015-76603 A 4/2015
JP 2017-034227 A 2/2017
KR 10-1999-0066108 A 8/1999
KR 10-2008-0102993 A 11/2008
KR 10-2014-0066437 A 6/2014
KR 10-1442402 B1 9/2014
KR 10-2015-0035947 A 4/2015
KR 10-2016-0032580 A 3/2016
KR 10-2016-0092674 A 8/2016

OTHER PUBLICATIONS

Office Action issued in corresponding Korean Patent Application No. 10-2017-0022547, dated Nov. 15, 2017, with English Translation.
Office Action issued in Japanese Application No. 2017-220141 dated Jan. 15, 2019, with English translation.

* cited by examiner

I-I'

COIL ELECTRONIC COMPONENT

CROSS-REFERENCE TO RELATED APPLICATION(S)

This application claims benefit of priority to Korean Patent Application No. 10-2017-0022547 filed on Feb. 20, 2017 in the Korean Intellectual Property Office, the disclosure of which is incorporated herein by reference in its entirety.

TECHNICAL FIELD

The present disclosure relates to a coil electronic component, and more particularly, to an inductor.

BACKGROUND

Electronic products such as a digital television (TV), a smartphone, a laptop computer, and the like typically transmit and receive data in a high frequency band. In the future, it is expected that such information technology (IT)-based electronic products will not only be used as individual devices, but will also be connected to one another through communications ports such as, for example, the universal serial bus (USB) connections, such that they will perform multiple and complex functions.

In accordance with the development of the smartphone, demand for a thin power inductor having a high current, high efficiency, high performance, and a small size has increased.

Therefore, products having a 2520 size and a thickness of 1 mm to a 2016 size and a thickness of 1 mm have been used, and have been miniaturized to a product having a 1608 size and a thickness of 0.8 mm.

At the same time, demand for an inductor array having an advantage, such as a smaller mounting area, has also increased.

The inductor array may have a non-coupled or coupled inductor form or a mixture of the non-coupled inductor form and the coupled inductor form, depending on a coupling coefficient or mutual inductance between a plurality of coil parts.

Meanwhile, in coupled inductors, leakage inductance is associated with an output current ripple, and mutual inductance is associated with an inductor current ripple. In order for the coupled inductor to have the same current ripple as that of the existing non-coupled inductor, the leakage inductance of the coupled inductor may be matched with an inductance of the existing non-coupled inductor. In addition, when the mutual inductance is increased, the coupling coefficient k is increased, such that the inductor current ripple may be reduced.

Therefore, in the case that the inductor current ripple is reduced while the coupled inductor having the same output current ripple as that of the existing non-coupled inductor at the same level as that of the existing non-coupled inductor, efficiency may be increased without increasing a mounted area.

Therefore, in order to increase the efficiency of the inductor array while maintaining a size of the inductor array, providing a coupled inductor of which a coupling coefficient is increased by increasing mutual inductance is desirable. In addition, in the coupled inductor, an interval between coils may be decreased in order to increase the coupling coefficient. However, there may be issues in a process of decreasing the interval. Therefore, a method of increasing the coupling coefficient between the coils while overcoming the limitation in the process described above is desirable.

SUMMARY

An aspect of the present disclosure may provide a coil electronic component in which a coupling coefficient between a plurality of coils may be increased.

According to an aspect of the present disclosure, a coil electronic component may include: a first coil; a second coil sharing a magnetic core of the first coil and wound in a direction the same as or different to a direction in which the first coil is wound; a main board disposed between the first and second coils; first and second external electrodes connected to the first coil; and third and fourth external electrodes connected to the second coil. The first coil may include a first coil pattern and a second coil pattern, and a first insulating layer may be disposed between the first and second coil patterns. The second coil may include a third coil pattern and a fourth coil pattern, and a second insulating layer may be disposed between the third and fourth coil patterns. The first insulating layer may include a through-hole forming a first magnetic core which is the magnetic core of the first coil, and the second insulating layer may include a through-hole forming a second magnetic core which is a magnetic core of the second coil.

According to another aspect of the present disclosure, a coil electronic component may include: a first coil; a second coil sharing a magnetic core of the first coil and wound in a direction the same as or different to a direction in which the first coil is wound; a main board disposed between the first and second coils; first and second external electrodes connected to the first coil; and third and fourth external electrodes connected to the second coil. The main board may include a through-hole formed in a central portion thereof and may not include a hole penetrating from an upper surface thereof to a lower surface thereof except for the through-hole. The upper surface of the main board may be in contact with a lower surface of the first coil and the lower surface of the main board may be in contact with an upper surface of the second coil. The first and second coils may have both end portions, connected to each other through a first via penetrating through a first insulating layer and a second via penetrating through a second insulating layer, respectively.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, embodiments of the present disclosure will be described in detail with reference to the accompanying drawings. In the accompanying drawings, shapes, sizes, and the like, of components may be exaggerated or shortened for clarity.

In the present disclosure, terms "lower side", "lower portion", "lower surface", and the like, have been used to indicate a direction toward a mounted surface of the semiconductor device in relation to cross sections of the drawings, terms "upper side", "upper portion", "upper surface", and the like, have been used to indicate an opposite direction to the direction indicated by the terms "lower side", "lower portion", "lower surface", and the like. However, these directions are defined for convenience of explanation, and the claims are not particularly limited by the directions defined as described above.

The meaning of a "connection" of a component to another component in the description includes an indirect connection through an adhesive layer as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Terms used herein are used only in order to describe an embodiment rather than limiting the present disclosure. In this case, singular forms include plural forms unless interpreted otherwise in context.

Hereinafter, a coil electronic component according to an embodiment of the present disclosure will be described. However, the present disclosure is not necessarily limited thereto.

Figure 1:
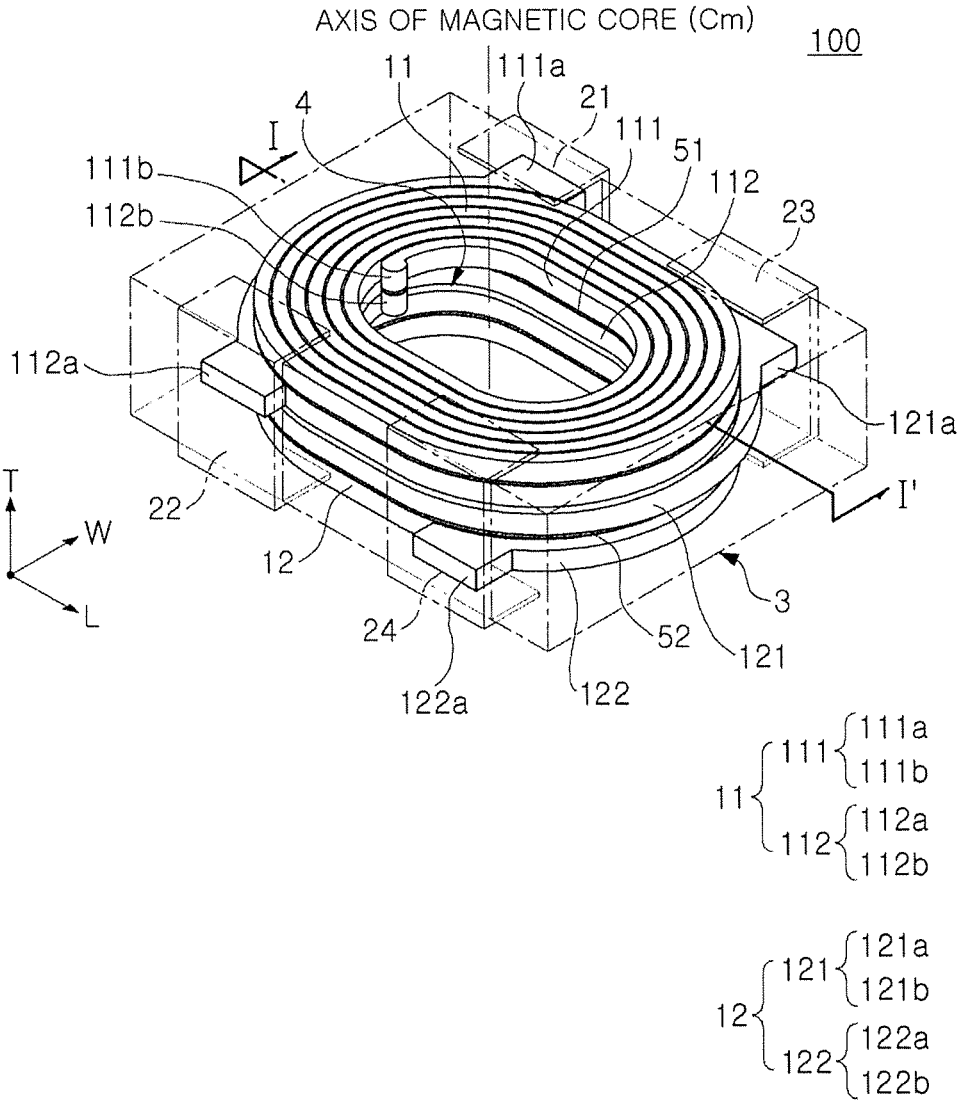
FIG. 1 is a schematic perspective view illustrating a coil electronic component according to an embodiment in the present disclosure.

FIG. 1 is a schematic perspective view illustrating a coil electronic component according to an embodiment. Referring to FIG. 1, a coil electronic component 100 includes a first coil 11 and a second coil 12. The first and second coils may be wound in, for example, a spiral shape, and may be wound in the same direction or opposite directions. In some embodiments, the first and second coils share a magnetic core with each other. In some embodiments, the first and second coils include first and second magnetic cores, respectively, and the first and second magnetic cores may be substantially matched with each other.

In addition, the first coil 11 includes a first coil pattern 111, and a second coil pattern 112 connected to and disposed above the first coil pattern. The second coil 12 may include a third coil pattern 121 and a fourth coil pattern 122 connected to and disposed above the third coil pattern. The first coil and the second coil may include the first and second coil patterns and the third and fourth coil patterns, respectively, to together constitute one coil. Here, the first to fourth coil patterns may be formed of a metal having excellent electrical conductivity, for example, silver (Ag), palladium (Pd), aluminum (Al), nickel (Ni), titanium (Ti), gold (Au), platinum (Pt), or alloys thereof.

The coil electronic component 100 includes a body 3 embedding the first and second coils therein. The body 3 may have upper and lower surfaces opposing each other in a thickness direction T, first and second surfaces opposing each other in a length direction L, and third and fourth surfaces opposing each other in a width direction W to have a substantially hexahedral shape, but is not limited thereto. The body 3 may form an appearance of the coil electronic component, and may include any material that exhibits a magnetic property. The body 3 may be formed, for example, by filling ferrite or a metal based soft magnetic material. Here, the ferrite may be Mn—Zn based ferrite, Ni—Zn based ferrite, Ni—Zn—Cu based ferrite, Mn—Mg based ferrite, Ba based ferrite, Li based ferrite, or the like, or a combination thereof. The metal based soft magnetic material may be an alloy including one or more selected from the group consisting of Fe, Si, Cr, Al, and Ni. In addition, a particle size of the metal based soft magnetic material may be 0.1 to 20 μm. The ferrite or the metal based soft magnetic material may be included in a polymer such as an epoxy resin, a polyimide resin, or the like, in a form in which it is dispersed in the polymer to constitute a composite, but is not limited thereto.

First, second, third and fourth external electrodes 21, 22, 23 and 24, respectively, are disposed on outer surfaces of the body 3.

The first external electrode 21 is connected to a first end portion (not explicitly shown) of the first coil, and the second external electrode 22 is connected to a second end portion (not explicitly shown) of the first coil 11. The first and second 22 external electrodes may be disposed, respectively, on the third and fourth surfaces of the body opposing each other in the width direction to face each other.

Likewise, the third external electrode 23 is connected to a third end portion (not explicitly shown) of the second coil, and the fourth external electrode 24 is connected to a fourth end portion (not explicitly shown) of the second coil 12. The third 23 and fourth 24 external electrodes may be disposed, respectively, on the third and fourth surfaces of the body opposing each other in the width direction to face each other.

In this case, the first 21 and third 23 external electrodes may serve as input terminals, and the second 22 and fourth 24 external electrodes may serve as output terminals, or vice versa.

The first to fourth external electrodes (21-24) may be formed of a metal having excellent electrical conductivity, for example, copper (Cu), silver (Ag), nickel (Ni), tin (Sn), or alloys thereof, and may include a plurality of layers, but are not limited thereto.

The first coil 11 and the second coil 12 are separated from each other by a main board 4 interposed therebetween. A first insulating layer 51 is disposed between the first 111 and second 112 coil patterns in the first coil, and a second insulating layer 52 is disposed between the third 121 and fourth 122 coil patterns in the second coil.

The main board 4 may include a through-hole formed in a central portion thereof. The through-hole may be filled with a magnetic material to constitute a core Cm and be thus advantageous in improving magnetic permeability of the coil electronic component.

The through-hole may have the same shape as that formed by a cross section of a region in which a magnetic material is filled in the magnetic core Cm of the first 11 and second 12 coils. In addition, a shape of an upper surface (not explicitly shown) of the main board 4 may be substantially the same as that of a lower surface of the first coil disposed on the upper surface of the main board 4, and a shape of a lower surface (not explicitly shown) of the main board 4 may be substantially the same as that of an upper surface of the second coil disposed on the lower surface of the main board 4.

The center of gravity of the through-hole may be formed on the magnetic core Cm shared by the first 11 and second coils 12. This means that center of the first magnetic core formed by the first coil 11 supported by the main board 4 and formed on the upper surface of the main board 4, center of the second magnetic core formed by the second coil 12 supported by the main board 4 and formed on the lower surface of the main board 4, and the center of gravity of the through-hole are substantially matched with one another.

The main board 4 may be interposed between the first coil 11 and the second coil 12 disposed below the first coil 11 to substantially remove mismatch between arrangements of the first coil 11 and the second coil 12.

Figure 2:
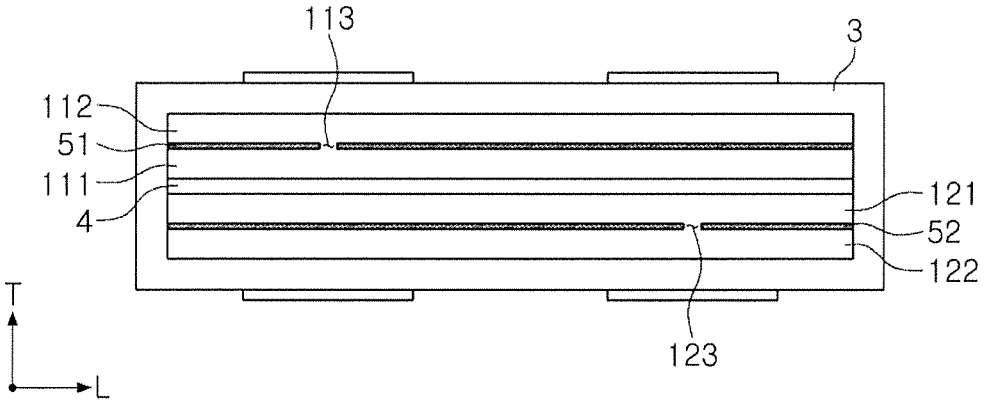
FIG. 2 is a schematic cross-sectional view taken along line I-I' of FIG. 1.

Next, FIG. 2 is a schematic cross-sectional view taken along line I-I' of FIG. 1. The main board 4, and the first insulating layer 51 and second insulating layer 52 in the coil electronic component 100 will be described in more detail with reference to FIG. 2.

First, the main board 4 interposed between the first coil 11 and the second coil 12 may be formed of a material that does not have a magnetic property, and may be, for example, a printed circuit board (PCB), but is not particularly limited thereto.

The main board 4 may have a thickness sufficient to support both of the first 11 and second 12 coils, for example, about 40 μm or more to about 120 μm or less, but is not limited thereto.

The first coil 11 may be disposed on the upper surface of the main board 4, and the second coil 12 may be disposed on the lower surface of the main board 4. The first 11 and second 12 coils may be arranged on the upper and lower surfaces of the main board, respectively, in a form in which they are symmetrical to each other in relation to the main board. Here, a term "symmetrical" means that materials or structures of the first 11 and second 12 coils, or areas or lengths occupied by the first 11 and second 12 coils on the surfaces of the main board 4 are substantially the same as each other.

The first coil 11 and the second coil 12 may be disposed to be spaced apart from each other by the thickness of the main board 4 or a distance greater than the thickness of the main board. For example, when the first coil and the second coil are spaced apart from each other by the thickness of the main board 4, the lower surface of the first coil 11 may be disposed to be in contact with the upper surface of the main board 4, and the upper surface of the second coil 12 may be disposed to be in contact with the lower surface of the main board 4. On the other hand, when the first coil 11 and the second coil 12 are spaced apart from each other by the distance greater than the thickness of the main board 4, a space formed between the lower surface of the first coil 11 and the upper surface of the main board may be filled with a magnetic material, composition and content of which are the same as those of the magnetic material filled in the body 3 of the coil electronic component 100.

Since the main board 4 is disposed in a space between the first 11 and second 12 coils, a phenomenon in which a magnetic flux flowing from the first coil 11 to the second coil 12 is leaked to the space between the first 11 and second 12 coils may be prevented. Resultantly, a mutual inductance Lm between the first coil 11 and the second coil 12 may be increased, and a coupling coefficient k of the coil electronic component 100 may be increased.

The first coil 11 and the second coil 12 may be physically disconnected from each other by the main board 4, which means that the main board 4 does not include a component for physically connecting the first 11 and second 12 coils to each other. For example, the main board 4 does not include a via hole, or the like, penetrating from the upper surface of the main board 4 to the lower surface of the main board 4 at all, and includes only a through-hole to be described below as a component penetrating from the upper surface of the main board 4 to the lower surface of the main board 4.

The first coil pattern 111 of the first coil 11 has end portions 111*a* and 111*b*. First end portion 111*a* of the first coil pattern 111 is connected to the first external electrode 21, and second end portion 111*b* of the first coil pattern 111 is connected to a first via 113. Likewise, the second coil pattern 112 of the first coil 11 has end portions 112*a* and 112*b*. First end portion 112*a* of the second coil pattern 112 is connected to the second external electrode 22, and Second end portion 112*b* of the second coil pattern 112 is connected to the first via 113. The first coil pattern 111 may be electrically connected to the second coil pattern 112 through the first via 113 penetrating through the first insulating layer 51.

The third coil pattern 121 of the second coil 12 has end portions 121*a* and 121*b*. First end portion 121*a* of the third coil pattern 121 is connected to the third external electrode 23, and second end portion 121*b* of the third coil pattern 121 is connected to a second via 123. Likewise, the fourth coil pattern 122 of the second coil 12 has end portions 122*a* and 122*b*. First portion 122*a* of the fourth coil pattern 122 is connected to the fourth external electrode 24, and second end portion 122*b* of the fourth coil pattern 122 is connected to the second via 123. The third coil pattern 121 may be electrically connected to the fourth coil pattern 122 through the second via 123 penetrating through the second insulating layer 52.

As an example, the first and third external electrodes 21 and 23 may be the input terminals, and the second and fourth external electrodes 22 and 24 may be the output terminals. Thus, a current input from the first external electrode 21, which is the input terminal, passes through the first coil pattern 111 and the first via 113 penetrating through the first insulating layer 51, passes through the second coil pattern 112, and then flows to the second external electrode 22, which is the output terminal. Likewise, a current input from the third external electrode 23, which is the input terminal, passes through the third coil pattern 121 and the second via 123 penetrating through the second insulating layer 52, passes through the fourth coil pattern 122, and then flows to the fourth external electrode 24, which is the output terminal.

The first and second insulating layers 51 and 52 may be in the form of a sheet. In some embodiments, the first and second insulating layers 51 and 52 are thin films and thicknesses of the first and second insulating layers 51 and 52, i.e., distances from upper surfaces of the first and second insulating layers 51 and 52 to lower surfaces thereof, are relatively small and are generally uniform. For example, the thickness of each of the first and second insulating layers 51 and 52 may be about 10 μm or more to about 50 μm or less, may be about 40 μm or less to be smaller than that of the main board 4, and may be controlled to be about 10 μm to about 15 μm so as to miniaturize a chip component.

The first and second insulating layers 51 and 52 may be formed of a material having an insulating property, for example, a thermosetting resin in consideration of easiness of a process control.

The first and second insulating layers 51 and 52 may be formed of any one of a build-up film, more specifically, an Ajinomoto build-up film (ABF) and equivalents thereof. However, material of each of the first and second insulating layers 51 and 52 is not limited as long as it has an insulating property. The ABF may be a material for a build-up process, and may have a thermosetting property. In addition, since it is easy to form micro vias in the ABF by a laser beam, it may be advantageous in forming the first and second vias 113 and 123 to use the ABF as the material of each of the first and second insulating layers 51 and 52.

The first and second insulating layers 51 and 52 may further include separate through-holes formed in central portions thereof as well as the first and second vias 113 and 123, respectively, and the through-holes may be substantially configured on the basis of the magnetic core Cm shared by the first coil 11 and the second coil 12. In addition, the through-hole of the first insulating layer and the through-hole of the second insulating layer may have substantially the same shape, area, and the like, as those of the through-hole of the main board.

Next, an example of a method of manufacturing the coil electronic component illustrated in FIGS. 1 and 2 will be described. However, a method to be described below is only an example, and may be appropriately designed and modified by those skilled in the art in consideration of process requirements and environments.

First, a main board having the through-hole may be prepared, and independent coil patterns may be formed on the upper surface and the lower surface of the main board, respectively. The coil patterns may include the first and third coil patterns (e.g., 111 and 121 of FIGS. 1 and 2). A manner of forming the coil patterns is not limited, but may be, for example, a manner of filling an electrically conductive metal in openings of a plating resist by a process such as electroplating, or the like. Here, the plating resist, which is generally a photosensitive resist film, may be a dry film resist, or the like, but is not particularly limited thereto.

Then, for example, a build-up film having a thickness of about 10 to about 15 μm may be stacked as the first insulating layer on the coil patterns, and a hole penetrating through the first insulating layer may be formed, and additional coil patterns may be formed on the first insulating layer by plating. Then, in the same manner as the manner of forming the first insulating layer and forming the coil patterns on the first insulating layer, the second insulating layer may be formed on the coil patterns disposed on the lower surface of the main board, and coil patterns may be formed beneath the second insulating layer. In this case, the holes formed in the first insulating layer and the second insulating layer are filled with a material having electrical conductivity, such that two coils may be formed on and beneath the main board, respectively.

Then, processes of filling a magnetic particle-resin composite having a magnetic property to constitute the body forming an appearance of a chip, exposing end portions of the coil patterns through dicing, or the like, and disposing the external electrodes on the outer surfaces of the body to be electrically connected to the end portions may be performed.

In the coil electronic component manufactured through the processes described above, the first and second coils may be formed on and beneath the main board, respectively. Therefore, when the first and second coils that are physically independently formed are arranged, generation of coil alignment mismatch such as mismatch between the magnetic cores of the respective coils, or the like, may be effectively prevented.

Table 1 represents self-inductances, direct current (DC) resistances (Rdc), and coupling coefficients of a coil electronic component (Inventive Example 1) according to an embodiment in the present disclosure and a coil electronic component (Comparative Example 1) according to the related art.

For reference, the coil electronic component (Comparative Example 1) according to the related art is formed by independently preparing two coils and filling a magnetic material between the coils prepared in advance to dispose the respective coils at upper and lower portions, respectively. In this case, it is not easy to match magnetic cores of the respective coils with each other.

In Inventive Example 1 and Comparative Example 1 of Table 1, coil electronic components were inductors having chip sizes of 2520 1.0 T. In Inventive Example 1, a thickness of a main board between first and second coils was 60 μm, and the first coil, the main board, and the second coil were sequentially arranged from the top in a thickness direction of a body. On the other hand, an inductor of Comparative Example 1 was an inductor in which a magnetic material is filled on a second coil and a first coil is disposed on the magnetic material.

TABLE 1

| | Inventive Example 1 | | Comparative Example 1 | |
|---|---|---|---|---|
| | First Coil | Second Coil | First Coil | Second Coil |
| Self-inductance [μH] | 1.973 | 1.973 | 2.432 | 2.432 |
| Rdc | 174.5 | 174.5 | 174.52 | 174.52 |
| Coupling Coefficient (k) | −0.95 | | −0.55582 | |

As seen from Table 1, DC resistances Rdc of the first and second coils of the coil electronic component according to Inventive Example 1 are matched with those of the first and second coils of the coil electronic component according to Comparative Example 1. The reason is that DC resistances of coils are determined by three factors such as specific resistances specified by materials, or the like, of the first and second coils, areas of the coils, and lengths of the coils, and coil patterns of the first and second coils used in the coil electronic components according to Inventive Example 1 and Comparative Example 1 are substantially the same as each other.

Meanwhile, in Table 1, self inductances (Ls) of the first and second coils of the coil electronic component according to Inventive Example 1 are lower than those of the first and second coils of the coil electronic component according to Comparative Example 1. The reason is that the magnetic material is filled in a lower surface of the first coil and an upper surface of the second coil in the coil electronic component according to Comparative Example 1, such that a packing factor of the magnetic material in adjacent regions of the first and second coils is higher than that in the coil electronic component according to Inventive Example 1.

Referring to coupling coefficients of Table 1, the closer the absolute value of the coupling coefficient to 1, the larger the coupling coefficient, and a minus (−) sign means negative coupling. In this case, it may be appreciated that magnitude of the coupling coefficient of the coil electronic component according to Inventive Example 1 in Table 1 is increased as compared to the coil electronic component according to Comparative Example 1 by about 70%, which means that a magnetic flux generated in a magnetic core of the first coil is transferred to a magnetic core of the second coil without being leaked.

As described above, in the coil electronic component according to Inventive Example 1, the coupling coefficient may be significantly improved, such that an inductor current ripple may be reduced and entire efficiency of a DC to DC converter may be increased.

As set forth above, according to embodiments of the present disclosure, when a plurality of coils are disposed in one chip to share their magnetic cores with one another, a coupling coefficient and efficiency of the coil electronic component may be increased without changing an interval between the plurality of coils.

While embodiments have been shown and described above, it will be apparent to those skilled in the art that modifications and variations could be made without departing from the scope of the present invention as defined by the appended claims.

What is claimed is:

1. A coil electronic component comprising:

a first coil wound in a first direction and having a magnetic core;

a second coil sharing the magnetic core of the first coil, the second coil being wound in the first direction or in a second direction different from the first direction;

a main board disposed between the first coil and the second coil;

a first external electrode and a second external electrode connected to the first coil; and a third external electrode and a fourth external electrode connected to the second coil, wherein the first coil comprises a first coil pattern disposed on a first surface of a first insulating layer and connected to the first external electrode and a second coil pattern disposed on a second surface of the first insulating layer and connected to the second external electrode, the second coil comprises a third coil pattern disposed on a first surface of a second insulating layer and connected to the third external electrode and a fourth coil pattern disposed on a second surface of the second insulating layer and connected to the fourth external electrode, the first insulating layer comprises a through-hole forming the magnetic core of the first coil, and the second insulating layer comprises a through-hole forming a magnetic core of the second coil, the first and second insulating layers are not disposed directly on the main board, each of the first insulating layer and the second insulating layer has a thickness of about 10 μm or more to about 50 μm or less, and each of the thicknesses of the first insulating layer and the second insulating layer is smaller than a thickness of the main board.

2. The coil electronic component of claim 1, wherein the first coil is spaced apart from the second coil by a predetermined distance, and the second coil is physically disconnected from the first coil by the main board.

3. The coil electronic component of claim 1, wherein the first coil is disposed on an upper surface of the main board, and the second coil is disposed on a lower surface of the main board.

4. The coil electronic component of claim 1, wherein the main board comprises a through-hole disposed in a central portion of the main board, and a center of gravity of the through-hole is formed on the magnetic core shared by the first coil and the second coil.

5. The coil electronic component of claim 1, wherein the main board comprises a printed circuit board (PCB).

6. The coil electronic component of claim 1, wherein the first insulating layer comprises a first via and has a film shape, the first via penetrates from an upper surface of the first insulating layer to a lower surface of the first insulating layer, the second insulating layer comprises a second via and has a film shape, and the second via penetrates from an upper surface of the second insulating layer to a lower surface of the second insulating layer.

7. The coil electronic component of claim 1, wherein the first insulating layer and the second insulating layer comprise insulating films having a thermosetting property.

8. The coil electronic component of claim 3, a shape of the upper surface of the main board is the same as that of a lower surface of the first coil disposed on the upper surface of the main board, and a shape of the lower surface of the main board is the same as that of an upper surface of the second coil disposed on the lower surface of the main board.

9. The coil electronic component of claim 1, wherein the main board has a thickness of 40 μm or more and 120 μm or less.

10. A coil electronic component comprising:

a first coil wound in a first direction and having a magnetic core;

a second coil sharing the magnetic core of the first coil, the second coil being wound in the first direction or in a second direction different from the first direction;

a main board disposed between the first coil and the second coil;

a first external electrode and a second external electrode connected to the first coil; and a third external electrode and a fourth external electrode connected to the second coil, wherein the main board comprises a through-hole formed in a central portion of the main board and does not include a hole penetrating from an upper surface of the main board to a lower surface of the main board except for the through-hole, the upper surface of the main board is in contact with a lower surface of the first coil and the lower surface of the main board is in contact with an upper surface of the second coil, the first coil comprises a first end portion and a second end portion connected to the first end portion through a first via penetrating through a first insulating layer, the second coil comprises a third end portion and a fourth end portion connected to the third end portion through a second via penetrating through a second insulating layer, the first and second insulating layers are not disposed directly on the main board, each of the first insulating layer and the second insulating layer has a thickness of about 10 μm or more to about 50 μm or less, and each of the thicknesses of the first insulating layer and the second insulating layer is smaller than a thickness of the main board.

11. The coil electronic component of claim 10, wherein the first coil comprises a first coil pattern and a second coil pattern connected to the first coil pattern through the first via, the second coil comprises a third coil pattern and a fourth coil pattern connected to the third coil pattern through the second via, the first end portion of the first coil is connected to the first coil pattern and the second end portion of the first coil is connected to the second coil pattern, and the third end portion of the second coil is connected to the third coil pattern and the fourth end portion of the second coil is connected to the fourth coil pattern.

12. The coil electronic component of claim 11, wherein the first coil pattern and the second coil pattern are disposed, respectively, on and beneath the first insulating layer, the first insulating layer being interposed between the first coil pattern and the second coil pattern, and the third coil pattern and the fourth coil pattern are disposed, respectively, on and beneath the second insulating layer, the second insulating layer being interposed between the third coil pattern and the fourth coil pattern.

13. The coil electronic component of claim 12, wherein the first insulating layer and the second insulating layer are insulating films having a thermosetting property.

14. The coil electronic component of claim 12, wherein each of the first insulating layer and the second insulating layer has a thickness of about 10 μm or more to about 50 μm or less.

15. The coil electronic component of claim 12, wherein the first insulating layer comprises the first via penetrating from an upper surface of the first insulating layer to a lower surface the first insulating layer, and the second insulating layer comprises the second via penetrating from an upper surface of the second insulating layer to a lower surface the second insulating layer.

16. The coil electronic component of claim 10, wherein the first coil and second coil are embedded by a magnetic particle-resin composite.

17. The coil electronic component of claim 10, wherein a center of gravity of the through-hole is formed on the magnetic core shared by the first coil and the second coil.

18. The coil electronic component of claim 10, wherein a shape of the upper surface of the main board is the same as that of a lower surface of the first coil disposed on the upper surface of the main board, and a shape of the lower surface of the main board is the same as that of an upper surface of the second coil disposed on the lower surface of the main board.

19. A coil electronic component comprising:

a first coil wound in a first direction and having a magnetic core;

a second coil sharing the magnetic core of the first coil, the second coil being wound in the first direction or in a second direction different from the first direction;

a main board disposed between the first coil and the second coil;

a first external electrode and a second external electrode connected to the first coil; and a third external electrode and a fourth external electrode connected to the second coil, wherein the first coil comprises a first coil pattern disposed on a first surface of a first insulating layer and connected to the first external electrode and a second coil pattern disposed on a second surface of the first insulating layer and connected to the second external electrode, the second coil comprises a third coil pattern disposed on a first surface of a second insulating layer and connected to the third external electrode and a fourth coil pattern disposed on a second surface of the second insulating layer and connected to the fourth external electrode, the first insulating layer comprises a through-hole forming the magnetic core of the first coil, and the second insulating layer comprises a through-hole forming a magnetic core of the second coil, the first and second insulating layers are not disposed directly on the main board, and the main board has a thickness of 40 μm or more and 120 μm or less.

* * * * *